US007862020B2

(12) United States Patent
Haller et al.

(10) Patent No.: US 7,862,020 B2
(45) Date of Patent: Jan. 4, 2011

(54) METHOD FOR FORMING STACKS FROM UPRIGHT POSITIONED, SUCCESSIVELY LINED UP SIGNATURES AND ARRANGEMENT FOR REALIZING THE METHOD

(75) Inventors: Mirko Haller, Strengelbach (CH); Christof Keller, Newport News, VA (US)

(73) Assignee: Mueller Martini Holding AG, Hergiswil (CH)

( * ) Notice: Subject to any disclaimer, the term of this patent is extended or adjusted under 35 U.S.C. 154(b) by 739 days.

(21) Appl. No.: 11/700,883

(22) Filed: Feb. 1, 2007

(65) Prior Publication Data

US 2007/0187886 A1 Aug. 16, 2007

(30) Foreign Application Priority Data

Feb. 2, 2006 (EP) ..... 06405051

(51) Int. Cl.
*B65H 39/00* (2006.01)

(52) U.S. Cl. ..... 270/52.16; 270/52.01; 270/52.14; 270/58.29; 270/58.33

(58) Field of Classification Search ..... 270/12, 270/15, 17, 52.01, 52.14, 52.16, 58.29, 58.33; 53/528, 542; 198/418.8
See application file for complete search history.

(56) References Cited

U.S. PATENT DOCUMENTS 4,038,909 A 8/1977 Preisig
4,531,343 A * 7/1985 Wood ..... 53/399
4,611,705 A * 9/1986 Fluck ..... 414/798.9
4,641,489 A * 2/1987 Wood ..... 53/529
6,782,678 B1 * 8/2004 Bodereau ..... 53/542
6,840,369 B2 * 1/2005 Derenthal et al. ..... 198/426
7,021,035 B2 * 4/2006 Muri et al. ..... 53/542
7,200,976 B2 * 4/2007 Gosslinghoff ..... 53/399

FOREIGN PATENT DOCUMENTS

EP 0 623 542 A1 11/1994
EP 1 199 275 A1 4/2002
EP 1 378 472 A1 1/2004
JP 05 178522 A 7/1993

OTHER PUBLICATIONS

International Search Report dated Jul. 24, 2006, issued in EP 06405051.

* cited by examiner

*Primary Examiner*—Leslie A Nicholson, III
(74) *Attorney, Agent, or Firm*—Venable LLP; Robert Kinberg; Leigh D. Thelen

(57) ABSTRACT

Signatures are successively conveyed one after another by a conveying system from a printing press to a stack-forming device, in which the signatures are separated into stacks by a separating device. A remaining number of non-stacked signatures of a current production is counted with a counting device. The separating device separates the remaining number of signatures of the current production into standard stacks of a varying length between a minimum length and a maximum length based on the number of the counted remaining signatures.

11 Claims, 5 Drawing Sheets

METHOD FOR FORMING STACKS FROM UPRIGHT POSITIONED, SUCCESSIVELY LINED UP SIGNATURES AND ARRANGEMENT FOR REALIZING THE METHOD

CROSS-REFERENCE TO RELATED PATENTS AND PATENT APPLICATIONS

This application claims the priority of European Patent Application No. EP 06405051, filed Feb. 2, 2006, the subject matter of which is incorporated herein by reference in its entirety.

The subject matter of each of the following documents is incorporated herein by reference in its entirety:

European Patent Document EP 0 623 542 A, filed May 3, 1994, by Hanspeter Roosli;

European Patent Document EP 1 199 275 A, filed Oct. 20, 2000, by Christof Keller; and European Patent Document EP 1 378 472 A, filed Jul. 2, 2002, by Christof Keller.

BACKGROUND

The invention relates to a method for forming stacks of specific length, which can vary, using upright positioned and successively lined up signatures. The signatures are supplied one after another with a conveying system from a printing press to a stack-forming device where the signatures are separated into individual stacks by a separating device.

The invention furthermore relates to an arrangement for realizing such method.

One skilled in the art will also refer to stacks of the aforementioned type as bundles and to the stack-forming device as a bundle delivery device. Stacks of this type are formed in particular on offset printing as well as sheet-fed photogravure rotary machines, wherein the stacks are formed inside the stack-forming device. The signatures to be stacked are supplied with transport belts to the stack-forming device. In the stack-forming device, the signatures are pushed together while positioned on the bound edge. During the further processing, the signatures are pulled off, for example, in a feeder for a gathering and wire-stitching machine and perfect binder, so that book blocks can be produced with these signatures.

Devices for forming such stacks are described, for example, in European Patent Documents EP 0 623 542 A and EP 1 199 275 A, identified above, which describe methods and systems to compress and strap the stacks. A device for palletizing the compressed and strapped stacks is described, for example, in European Patent Document EP 1 378 472 A, identified above. For suitable palletizing and further processing, the stacks are typically required to have a specific length, for example, in the range from about 500 to about 1200 mm.

The signatures to be stacked are produced, for example, in a rotary or digital printing press, which can operate at extremely high capacities. Such machines can switch quickly from a production A to a production B, for example, with a plate change. The different productions are separated inside the stack-forming device. Stacks containing items from both productions A and B might not be tolerated. Therefore, the stacks should comprise only items from one production, thus making it necessary to have a separation between the stacks composed of different production items. Until now, this has been achieved with a comparably high accumulation of waste materials at the end of the production run. Additionally, a comparably long period for the changeover has been required between different productions, since the conveying system at the end of a production contains remaining items which cannot be used to form a stack. Such items are either treated as waste material and are discarded or such items are transferred out and subsequently placed manually onto a pallet. Thus, in the systems available today a manual intervention is required before the start of each subsequent production, which might result in a comparably long changeover time.

The described problems are especially prominent when printing small editions such as paperbacks and other books or print products. The small editions impose especially high requirements for a cost-effective production. To lower the costs, it is particularly important with the small editions to prevent the unnecessary accumulation of waste and avoid manual operations.

SUMMARY

It is therefore an object of the present invention to provide a method and an arrangement, which avoids the above-listed and other disadvantages, in particular to substantially reduce a number of items to be discarded and to change from one production to another without a substantial changeover period. The bundles and/or stacks that are produced are separated into the respective production types.

The above and other objects are accomplished according to the invention, which in one embodiment comprises a method for forming stacks from signatures successively conveyed one after another by a conveying system from a printing press to a stack-forming device, in which the signatures are separated into stacks by a separating device, the method comprising: counting a remaining number of non-stacked signatures of a current production with a counting device; and separating with the separating device the remaining number of signatures of the current production into standard stacks of a varying length between a minimum length and a maximum length based on the number of the counted remaining signatures.

A standard stack is understood to mean, for example, a stack having a minimum length of about 300 mm or a maximum length of about 1200 mm. A standard stack of this type permits a preferably automatic palletizing on standardized pallets and a suitable further processing.

The method according to the invention prevents that a number of signatures remain at the end of a production cannot be processed automatically or through manual intervention and formed into a predetermined stack. In addition, the method allows for a direct changeover from production A to production B. The only waste materials to be discarded are the print-related sheets accumulating during the changeover, wherein these generally include only a few items.

The arrangement according to an embodiment of the invention is provided with a device for counting items, which determines the number of items remaining from each production and transmits this information to a control unit. A suitable computer divides the number of remaining items so that stacks of varying lengths can optimally be formed with the remaining production items.

BRIEF DESCRIPTION OF THE DRAWINGS

The described and other features and advantages of the invention will be further understood from the following detailed description with reference to the accompanying drawings in which.

DETAILED DESCRIPTION OF THE EXEMPLARY EMBODIMENTS

Figure 1:
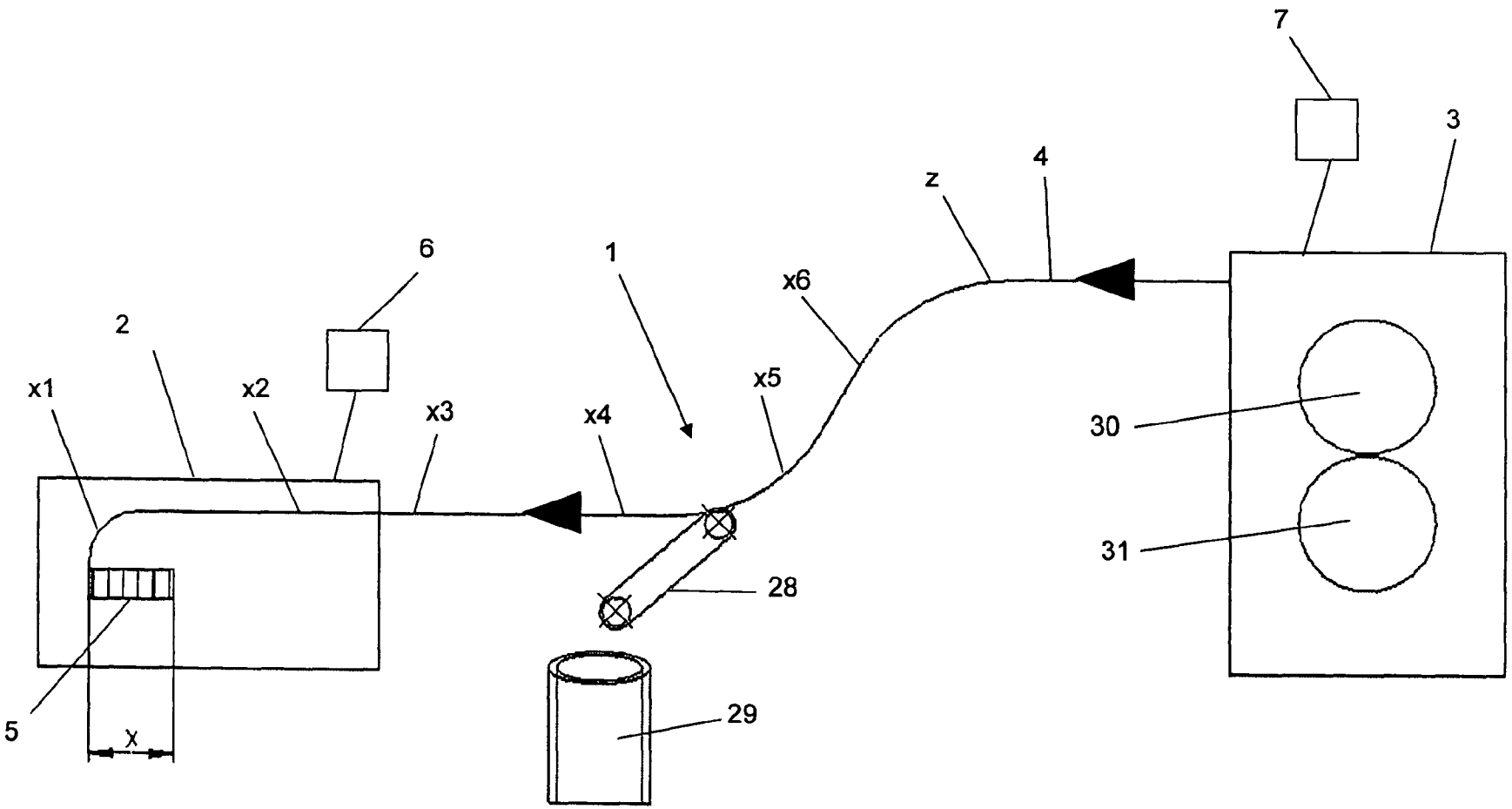
FIG. 1 shows a schematic view of an arrangement according to an embodiment of the invention.

FIG. 1 shows an apparatus or arrangement 1 according to an embodiment of the invention, which includes a stack-forming device 2, having a separating device 15 (see FIGS. 2*a*, 2*b*, 2*c*, 2*d*, 2*e*, 3 and 4), a control unit 6 and a conveying system 4. According to FIG. 2*a*, the conveying system 4 may be used to supply signatures 8 to the stack-forming device 2, either individually or in an overlapping flow S.

The signatures 8 are produced in a printing press 3. In FIG. 1, the printing press 3 is shown schematically with a plate cylinder 30 and a rubber-blanket cylinder 31. The printing press 3, for example, is a rotary printing press, but can also be a digital printing press. The printing press 3 permits a changeover from a production A to a production B (FIG. 2*b*), as well as to other productions. The changeover can take place in a manner known in the art, for example, by changing a plate. The changeover can take place without interruption and results, for example, only in 20 to 50 waste material printing items to be discarded, which accumulate during the plate change. The signatures 8 are printed during a production A, for example, and the signatures 9 are printed during a production B (FIG. 2*b*). The signatures 8, 9 may be used for producing book blocks. However, the signatures may also be used for producing other types of print products, for example brochures and the like. A counting device 7 is used to count the signatures 8, 9, which are printed in the printing press 3. The counting device 7 may be a laser counting head, for example, and is arranged in a rotary removal system (not shown). The count number of the counted signatures 8, 9 is transmitted to the control unit 6. Based on the counting operation and the known length of the conveying system 4, the number of the signatures 8, 9, which are positioned on the conveying system 4, is computed. The control unit 6 is continuously supplied with the data relating to the signatures 8, 9, which are located on the conveying system 4.

A discharge belt 28 or a different type of a transfer-out device is located at a suitable location of the conveying system 4 and may be used to deliver defective signatures 8 and 9 to a container 29.

In the stack-forming device, the signatures 8, 9 are stacked on a table 13. A stack 5 formed in this way is comparably loose. A specific number of the stacked signatures 8, 9 is respectively separated off, the stacks are compressed, and then strapped. The strapped stacks 5 are, for example, palletized automatically or supplied in other ways to a storage unit. The stacks 5 typically have a minimum length and do not exceed a maximum length, so that the stacks can be palletized and further processed in a suitable manner. The compressing of the stacks and the transfer out are described, for example, in European Patent Documents EP 0 623 542 A, EP 1 199 275 A, and EP 1 378 472 A, identified above.

A number of stacks 5 that can be formed with the signatures 8 of a production A, for example, can differ considerably and can range from few stacks 5 for a small production run to several hundred stacks for a large production run.

The present invention concerns processing of the remaining items of the production A and/or B. The remaining items are the signatures 8, 9 still remaining on the conveying system 4 and/or in the overlapping flow S, following a production change. The sum of items x1 to x6 plus z represents a number of the remaining items according to FIG. 1. The items x1 to x6 are respectively present in numbers, which result in the stack 5 of a specific length, for example 800 mm. Items z are the items at the end of the production run. However, these items would not result in a stack having a specific length. With the methods according to prior art, the items z had to be processed manually or transferred out, which required an interruption in the production.

According to an embodiment of the invention, the data referring to the count of the remaining number of items in the production A, B is continuously supplied to the control unit 6. The control unit 6 may adaptively determine a number of signatures or remaining items in bundles 5', so that a residual number of items z is sufficient to form a specific stack, which can be strapped and palletized in a suitable manner. The adaptation occurs with an aid of a suitable computer program, for example, and preferably occurs continuously, because some items may still have to be transferred out, thereby causing the number of the remaining items to change.

Print-related waste material can accumulate following the items z, during a changeover to a production B, which is then transferred out with the discharge belt 28. The changeover in production and/or the end of a production run is signaled with a signal from the printing press 3 to the control unit 6. The control unit 6 is therefore continuously informed about the remaining number of items from the production A, even after a changeover in the production. It is possible for a short gap to develop between the productions A and B as a result of the transfer out of the printing-related waste. However, the changeover in production occurs without interruption of the operation and during a comparatively short interval, for example, within a few seconds.

Individual steps of the method according to the invention are explained in further detail with reference to FIGS. 2*a* to 2*d*, 3 and 4.

Figure 2A:
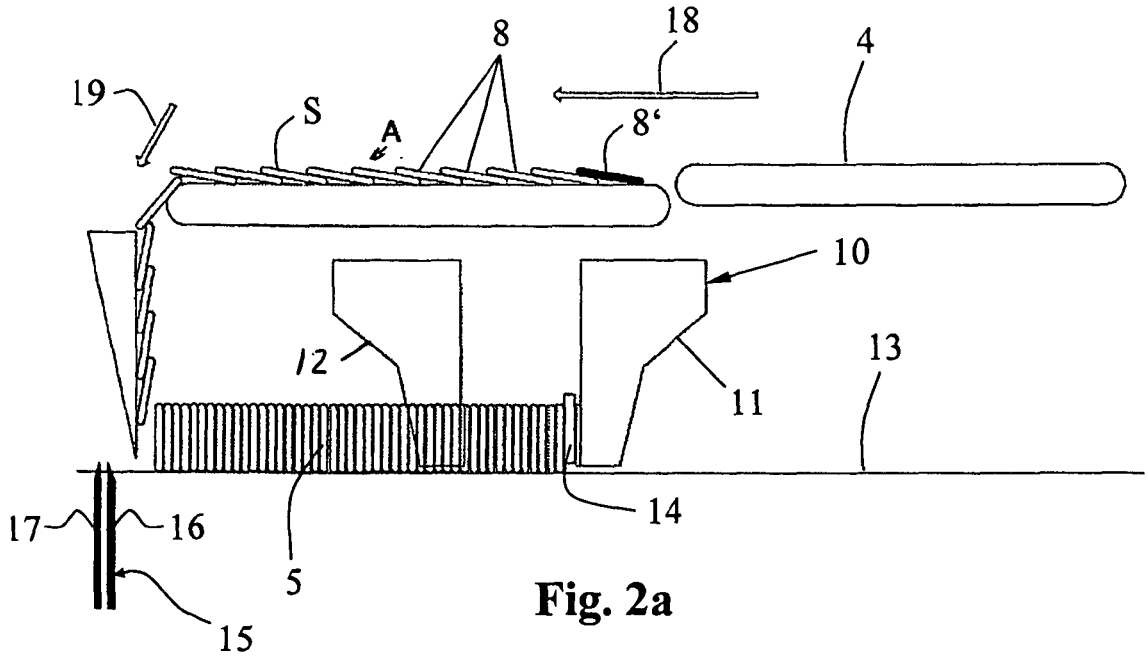
FIGS. 2*a*-2*e* schematically show individual phases of the stack forming operation, in a view from the side of the arrangement according to an embodiment of the invention.
Figure 2B:
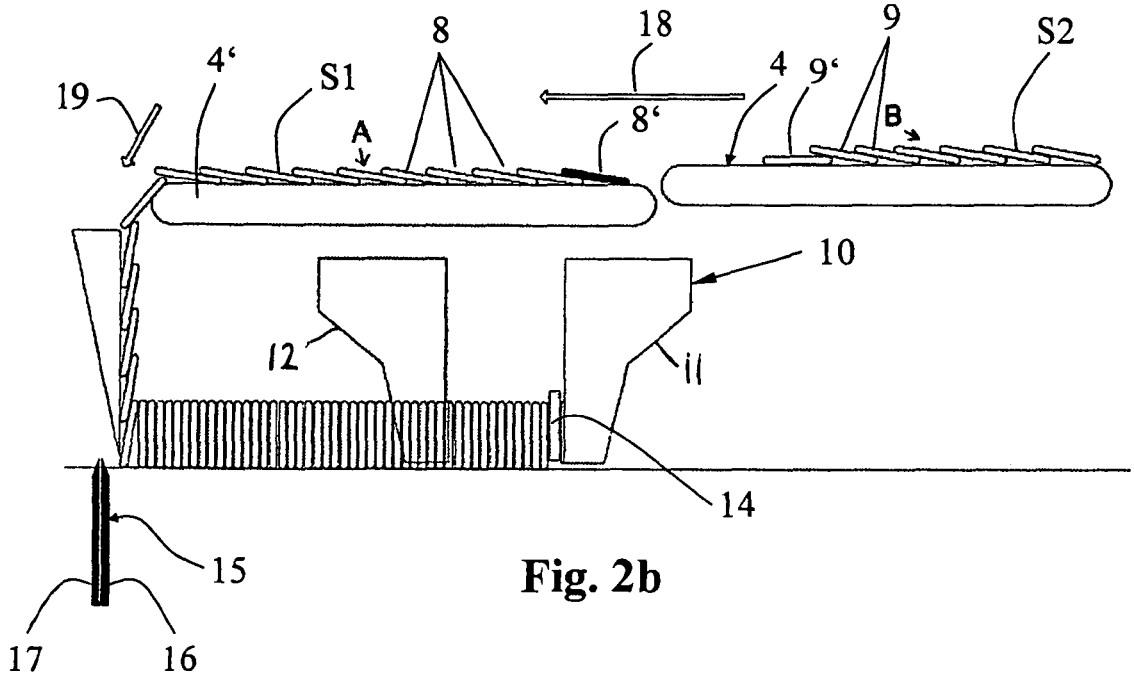
Figure 2C:
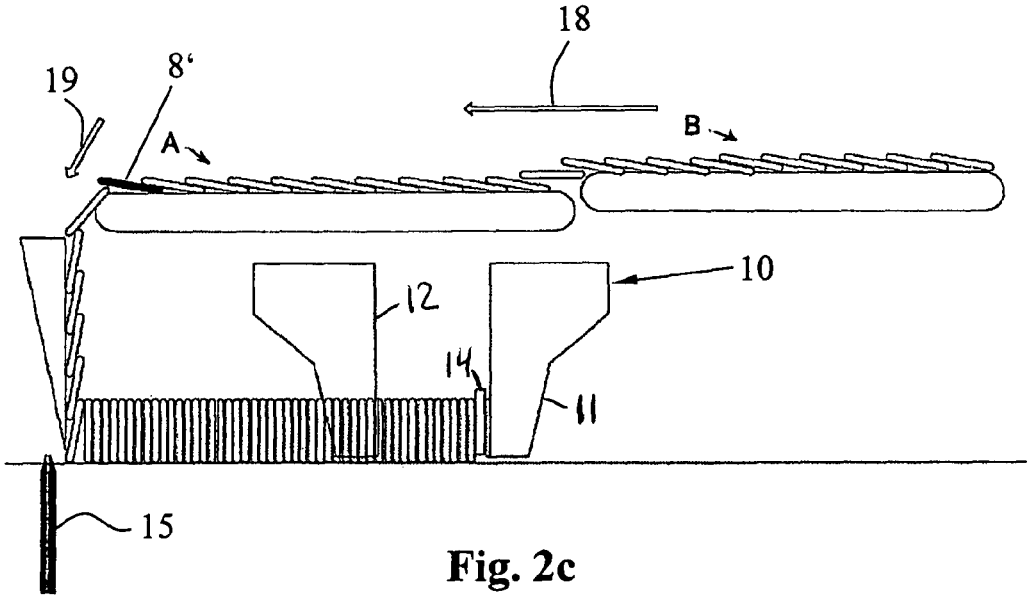

FIG. 2*a* shows the stack forming for the production A. A loose stack 5 has already been formed on a table 13 and/or on a support of the stack forming device 2. The stack 5 is supported on a pressure clamp 11 of a pressing device 10. A plate 14 is arranged between the pressure clamp 11 and the stack 5, such as, for example, a wooden plate which may be used later on for the strapping operation. A second pressure clamp 12 is not yet in use at this stage. The overlapping flow S moves continuously first in a horizontal direction as shown with an arrow 18 and then, following a deflection, in a vertical downward direction as shown with an arrow 19 and onto the table 13. The last item and/or the last signature of the production A is denoted as 8'. FIG. 2*a* shows a separating device 15 with two fingers 16 and 17 in a position of rest.

FIG. 2*b* shows an arrangement with the signatures 9 of a subsequent production B. The signatures 9 form an overlapping flow S2. A first item of the production B is denoted as 9'.

A gap between the production A and the production B is closed by correspondingly delaying a transport section 4'.

Figure 2D:
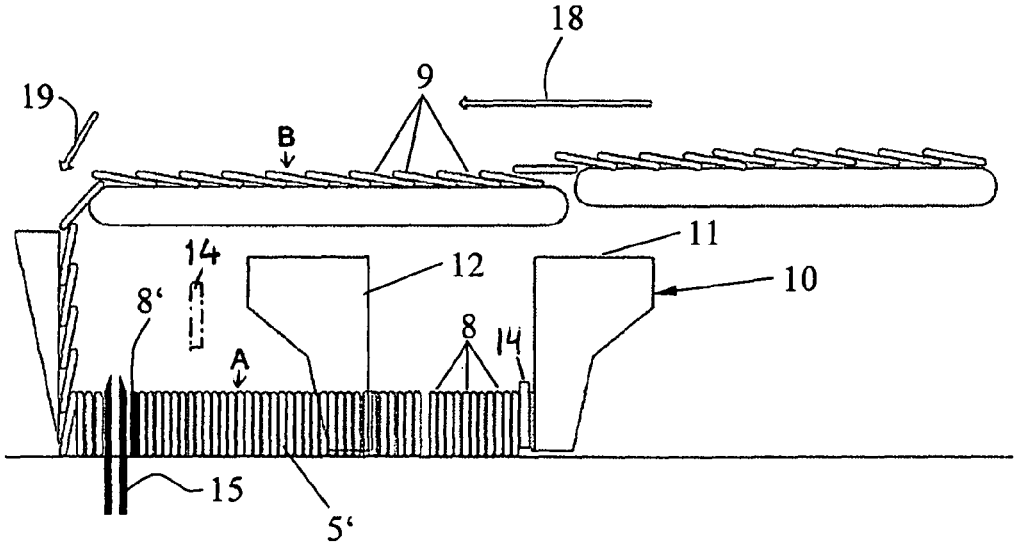
Figure 2E:
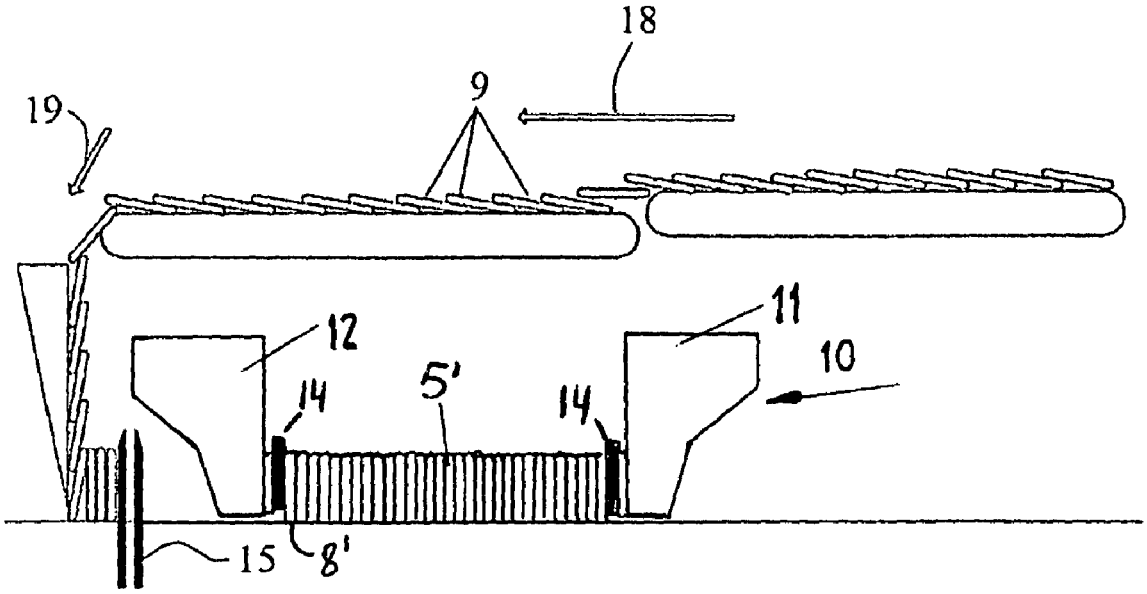

If the last signature 8' is fed into a stack 5', as shown in FIG. 2*d*, the fingers 16 and 17 are moved from the resting position to an active position, and the stack 5' is separated off. The stack 5' is the last stack of the production A and includes the last signature 8' as a final signature. As shown in FIG. 2*e*, the stack 5' is gripped by the pressing clamp 12 of the pressing device 10 and is compressed and strapped between two end plates 14. Finally, the strapped stack 5' is automatically palletized.

Figure 3:
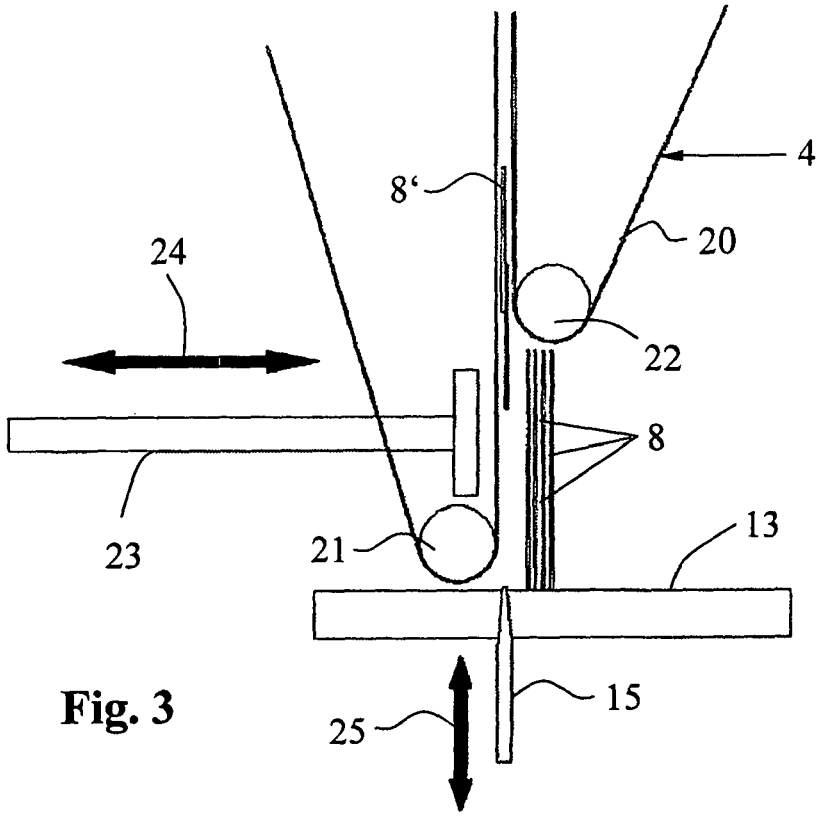
FIG. 3 shows a partial view of an arrangement according to an embodiment of the invention, designed to illustrate the forming of a clearance space in the stack-forming device.
Figure 4:
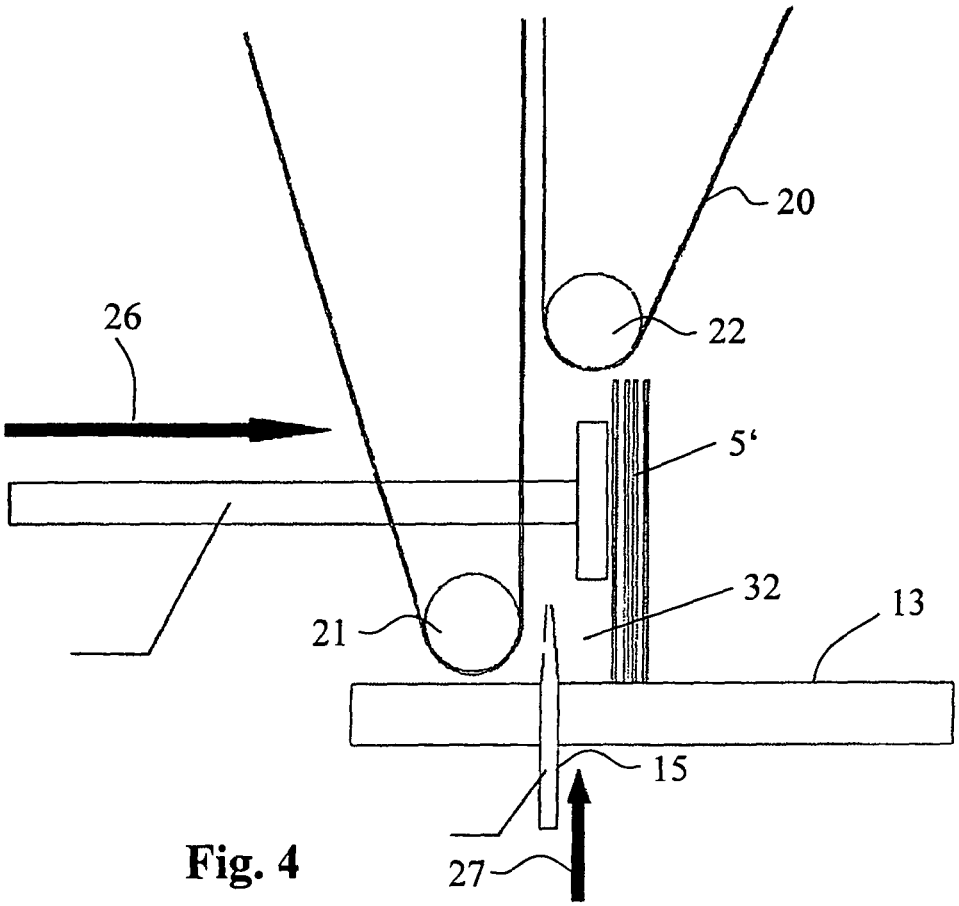
FIG. 4 shows a view according to FIG. 3, in which the clearance space has already been formed.

FIGS. 3 and 4 illustrate the separation of the production A from the production B. FIG. 3 shows the feeding of the last signatures 8 into the formed stack. The final signature 8' is shown positioned in a region of deflecting rollers 21 and 22 of the conveying system 4. A belt 20 is fitted around the roller 22. As shown, the last signature 8' is conveyed vertically downward until it hits the table 13 with its bound edge. At that instant, a pusher element 23 is moved against the stack and/or the last signature 8' via, for example, an optional drive such as, for example, an adjustment cylinder. The belt 20 includes partial belts, arranged at a distance from one another, between which the pusher element 23 can extend. The loose signatures 8 disposed on the table 13 are pushed by the pusher element 23 into the position shown in FIG. 4, so that a clearance space 32 is created through which the separating device 15 can be inserted from below, as shown by an arrow 27. Following the depositing of the signature 8', the pusher element 23 is moved back to the starting position, shown in FIG. 3. The separating device 15 is placed against the stack 5' for support. At the same time or immediately thereafter, the signatures 9 of the production B are supplied to the stack-forming device 2, as shown in FIG. 2*d*. As described above, the plate 14 may be inserted between the signatures, with one of the fingers 16, 17. The stack 5 can thus be compressed with the pressing device 10 and subsequently strapped. The separating device 15 is moved once more to the starting position that is shown in FIG. 2*a* and/or in FIG. 3. The double arrow 24 shown in FIG. 3 indicates the back and forth movement of the pusher element 23. The arrow 26 shown in FIG. 4 indicates the direction in which the stack 5 is compressed. The double arrow 25 shown in FIG. 3 shows the movements of the fingers 16 and 17. The arrow 27 shown in FIG. 4 illustrates the movement of the separating device 15 from a lower position toward an upper position. The movement of the separating device is coordinated with the movement of the pusher element 23. The aforementioned movements are controlled by the control unit 6.

The above explanations show that a change from the production A to the production B, as well as to other productions, is possible without interruption. The formed stacks 5' respectively contain only items from the same production, e.g. the signatures 8 from the production A or the signatures 9 from the production B. The formed stacks 5' are stacks of a specific length. The length of the stacks 5' is adapted so that no items z from the production A remain unstacked and go to waste. E.g., substantially all items z are used to form a stack.

It will be understood that the above description is susceptible to various modifications, changes and adaptations, and the same are intended to be comprehended within the meaning and range of equivalents of the appended claims.

What is claimed is:

1. A method for forming stacks from signatures successively conveyed one after another by a conveying system from a printing press to a stack-forming device, in which the signatures are separated into stacks by a separating device, the method comprising:

counting a remaining number of non-stacked signatures of a first production remaining on the conveying system following a production change with a counting device; and separating with the separating device the remaining number of signatures of the first production into standard stacks of varying length between a minimum length and a maximum length based on the number of the counted remaining signatures.

2. The method according to claim 1, wherein the step of counting includes:

continuously counting the remaining signatures.

3. The method according to claim 1, further including:

dividing the counted remaining signatures among the standard stacks of varying length prior to the separating step.

4. The method according to claim 1, wherein the separating step includes:

forming a last stack only with the remaining signatures of the first production; and forming a subsequent stack only with signatures of a subsequent second production.

5. The method according to claim 1, further including:

forming a clearance space in the stack-forming device after the remaining signatures of the first production are supplied to the stack-forming device; and inserting a separating member into the clearance space.

6. The method according to claim 5, wherein the step of forming the clearance space includes:

pushing the remaining signatures with a pusher element that moves back and forth in a longitudinal direction.

7. The method according to claim 1, further including:

forming stacks of a specific length prior to separating the remaining signatures of the first production into the standard stacks of varying length.

8. An apparatus for forming stacks of signatures conveyed from a printing press, comprising:

a conveying system to transport signatures to be stacked from the printing press;

a stack-forming device arranged to receive the signatures from the conveying system, the stack-forming device including a separating device operative to separate the signatures into stacks in the stack-forming device;

an item-counting device to determine a number of remaining signatures of a first production remaining on the conveying system following a production change; and a control unit to control a movement of the separating device as a function of the number of the counted remaining signatures of the first production, wherein the stack-forming device forms stacks of a specific length prior to separating the remaining signatures of the first production into standard stacks of varying length based on the number of remaining signatures of the first production.

9. The apparatus according to claim 8, wherein the item-counting device is connected downstream of the printing press.

10. The apparatus according to claim 8, wherein the separating device includes:

a pusher element, which is moved to push the signatures of a stack to form a clearance space.

11. The apparatus according to claim 10, wherein the separating device includes:

a separating element which is inserted into the clearing space following a last remaining signature of the first production to separate the signatures of the first production from signatures of a subsequent second production.

* * * * *